US006678919B1

(12) United States Patent
Sokolov et al.

(10) Patent No.: US 6,678,919 B1
(45) Date of Patent: Jan. 20, 2004

(54) HINGE ASSEMBLY FOR GAMING MACHINE BELLY DOOR

(75) Inventors: Richard Sokolov, Kingsford (AU); Errol D'Souza, Hornsby (AU); Vladimir Halic, Wollongong (AU); Ian Frederick Johnson, Pennant Hills (AU)

(73) Assignee: Aristocrat Technologies Australia PTY LTD, Lane Cove (AU)

( * ) Notice: Subject to any disclaimer, the term of this patent is extended or adjusted under 35 U.S.C. 154(b) by 0 days.

(21) Appl. No.: 10/130,172

(22) PCT Filed: Nov. 8, 2000

(86) PCT No.: PCT/AU00/01371

§ 371 (c)(1),
(2), (4) Date: Oct. 15, 2002

(87) PCT Pub. No.: WO01/34929

PCT Pub. Date: May 17, 2001

(30) Foreign Application Priority Data

Nov. 11, 1999 (AU) ..... PQ3990

(51) Int. Cl.[7] ..... E05D 7/10

(52) U.S. Cl. ..... 16/266; 16/254; 16/380; 16/365

(58) Field of Search ..... 16/254, 262, 266, 16/365, 228, 386, 380; 273/148 R, 148 B

(56) References Cited

U.S. PATENT DOCUMENTS

| | | | | | |
|---|---|---|---|---|---|
| 132,053 | A | * | 10/1872 | Child | 16/266 |
| 230,491 | A | * | 7/1880 | Peer | 16/266 |
| 1,063,158 | A | * | 5/1913 | Giles | 16/266 |
| 2,677,147 | A | * | 5/1954 | Phillips | 16/266 |
| 3,805,325 | A | * | 4/1974 | Lee | 16/262 |
| 4,584,739 | A | * | 4/1986 | Konen | 16/266 |
| 4,827,568 | A | * | 5/1989 | Ramsauer | 16/266 |
| 6,070,297 | A | * | 6/2000 | Borer | 16/266 |
| 6,151,757 | A | * | 11/2000 | Beals et al. | 16/380 |

FOREIGN PATENT DOCUMENTS

| | | | | |
|---|---|---|---|---|
| DE | 24014545 | A1 | | 7/1975 |
| DE | 2535917 | A1 | | 4/1976 |
| DE | 2748185 | A1 | * | 10/1977 |
| DE | 3611616 | A1 | | 10/1987 |
| DE | 3637244 | A1 | | 4/1988 |
| FR | 2690792 | A1 | * | 4/1993 |
| JP | 2000-107410 | A | * | 4/2000 |
| JP | 2001-70577 | A | * | 3/2001 |
| JP | 2002-263324 | A | * | 9/2002 |
| WO | WO 01/42602 | A1 | * | 6/2001 |

* cited by examiner

*Primary Examiner*—Chuck Y. Mah
(74) *Attorney, Agent, or Firm*—Knobbe, Martens, Olson & Bear, LLP

(57) ABSTRACT

A hinge assembly for a gaming machine including a hinge pin fixed to a door of the gaming machine and a outer sleeve fixed to a belly door frame. The outer sleeve includes first and second arms and is partially annular in cross-section defining a first gap between opposing ends of the arms. A pin element is fixed to a light chamber located behind the belly door frame and rotatably mounted inside the outer sleeve. A second gap is defined between free ends of the pin element. When the pin element is rotated to a particular orientation with respect to the outer sleeve, the first and second gaps align to allow the pin element and outer sleeve element to be simultaneously mounted around the hinge pin. Relative rotation of the pin element and outer sleeve misaligns the gaps thereby inhibiting the pin element and outer sleeve from becoming disengaged.

12 Claims, 8 Drawing Sheets

HINGE ASSEMBLY FOR GAMING MACHINE BELLY DOOR

CROSS-REFERENCE TO RELATED APPLICATIONS

This application is a National Phase application of PCT/AU00/01371 filed on Nov. 8, 2000, the disclosure of which is incorporated herein by reference in its entirety and claims the benefit of the Australian application PQ 3990 filed Nov. 11, 1999, and is related to and filed concurrently with Application No. UNKNOWN, which is a National Phase Application of PCT. Application No. PCT/AU00/01369.

FIELD OF THE INVENTION

This invention relates to a hinge assembly. The hinge assembly is particularly suited to use in gaming machines also referred to as slot machines, fruit machines or poker machines. In particular, the hinge assembly may be used to mount a belly door for a gaming machine.

BACKGROUND OF THE INVENTION

A typical standard sized gaming machine comprises a relatively tall cabinet and a main door which swings open on hinges to allow access to the interior of the cabinet. The main door typically extends almost the entire length of the cabinet from top to bottom. In the middle of the door, there is usually a shelf area on which a number of control buttons are located for use by a player. Often, a bill acceptor is disposed beneath the shelf area and a slot is provided in the shelf area allowing players to feed notes into the bill acceptor. It is common to have a door attached to the main door beneath the shelf, which is commonly referred to as a "belly door". The belly door allows access to the interior of the lower part of the gaming machine without the need to open the main door and more importantly displays artwork for the machine. Such artwork usually comprises a sheet of optical quality acrylic material on which a design identifying the game is screen printed. Typically, the artwork is edge lit by a fluorescent tube which is mounted in an assembly fixed to one vertical edge of the artwork.

In some gaming machines, two fluorescent light tubes are provided, one is mounted at the rear of the artwork in a horizontal position and another is mounted in a vertical position to the rear of the artwork. This arrangement produces uneven lighting with "hot spots" appearing when the front of the artwork is viewed. The main problem which arises is that the bill acceptor depends down from the shelf behind the belly door and this prevents a horizontally mounted fluorescent light bulb from extending from one side of the artwork to the other side. The tube may only extend part way. Because it is not possible to light the artwork between the artwork and the bill acceptor, there is typically a shadow behind the artwork where the bill acceptor is positioned and neither lighting system discussed above, solves this problem.

In the prior art the vertically mounted fluorescent light is enclosed in a C shaped chamber which is pivoted to a mount fixed to a vertical edge of the artwork. Because it is mounted to the edge of the artwork, the fluorescent light is also positioned close to one edge of the belly door and it is a difficult and fiddly process to pivot the chamber, remove the fluorescent light and replace it with another. Typically, it can take an engineer 15 minutes to change the artwork and fluorescent light tube.

The applicant's co-pending PCT patent application entitled "light chamber for gaming machine" addresses the problems of lighting artwork by providing a light chamber. The present application relates to a novel hinge assembly which can be used to mount both the chamber, and a frame of the belly door to the main door of the gaming machine. However the particular hinge assembly of the present invention is not restricted to use on gaming machines and may have applications in other areas outside gaming machines.

SUMMARY OF THE INVENTION

Thus in accordance with a first aspect of the present invention, there is provided a hinge assembly comprising:

a hinge pin, fixed to a first member;

an outer sleeve fixed to a second member, comprising first and second arcuate arms such that the sleeve is part-annular in cross-section defining a gap between opposing ends of the arms and wherein a support means is defined on an interior surface of the sleeve, below a top of the sleeve;

a part-annular pin element fixed to a third member, the pin being rotatably mounted inside the outer sleeve and wherein the pin defines a shoulder which in use rests on the support means defined by the outer sleeve, and wherein a second gap is defined between free ends of the pin element and wherein when the pin element is rotated to a particular orientation with respect to the outer sleeve, the gaps align to allow the pin element and outer sleeve to be simultaneously mounted around the hinge pin, with subsequent relative rotation of the pin element and outer sleeve preventing the pin element and outer sleeve from becoming disengaged from the hinge pin.

In the described embodiment below the first member is a main door for a gaming machine, the second member is a frame for a belly door of a gaming machine, and the third member is a chamber adapted to seal against the frame of the belly door.

The hinging arrangement described above, not only provides a means for hinging three members relative to each other, it also provides a simple method of hinge construction and assembly by the alignment of the two elongate gaps for mounting over a hinge pin.

Typically, to avoid the hinge assembly accidentally falling apart, the arrangement of the second and thirds members relative to each other which aligns the gaps, would be one which would not normally occur in practice.

BRIEF DESCRIPTION OF THE DRAWINGS

The invention will now be described, by way of example only, and with reference to the accompanying drawings in which.

DETAILED DESCRIPTION OF PREFERRED EMBODIMENT

Figure 1:
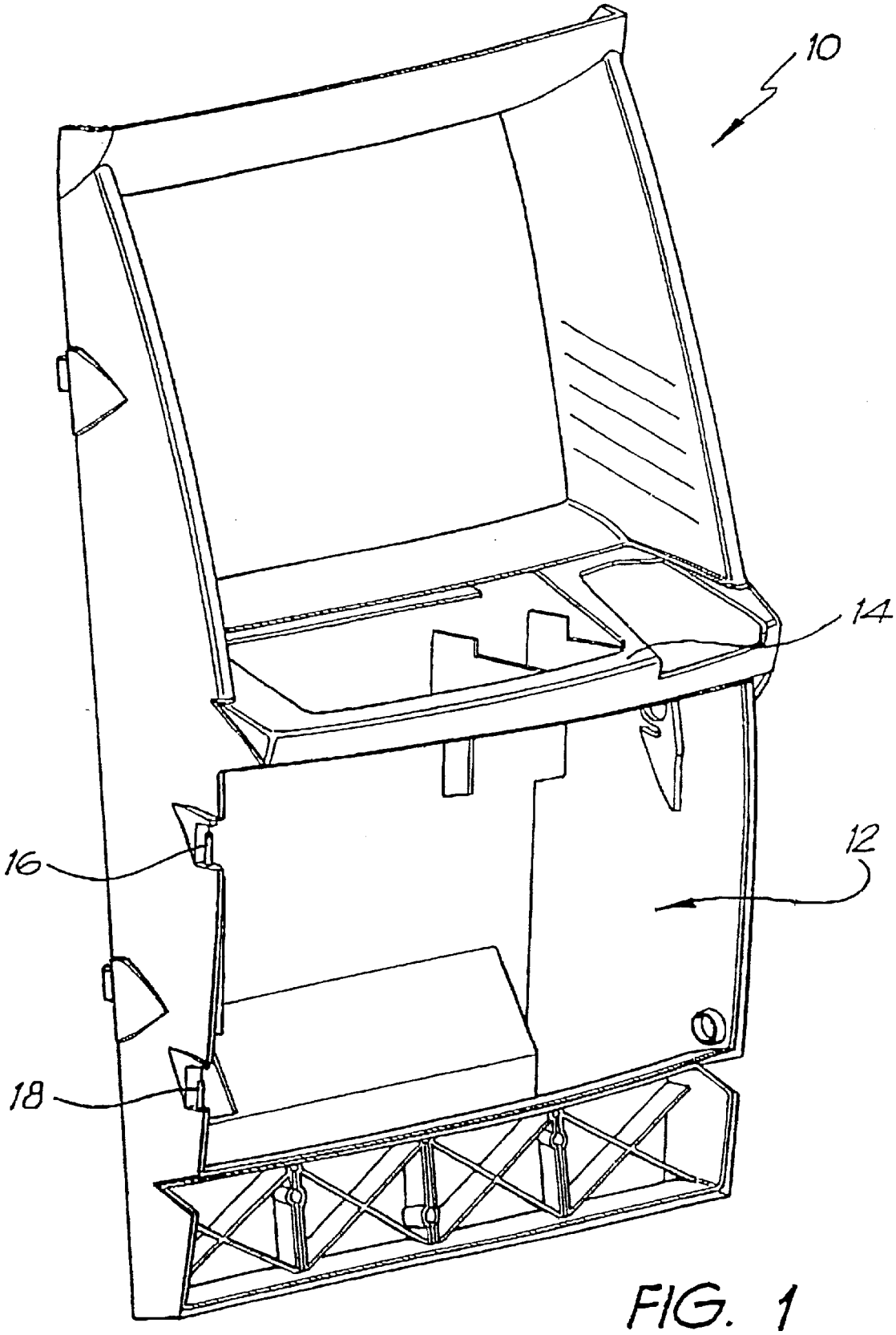
FIG. 1 shows a main door for a gaming machine.

Referring to the drawings, FIG. 1 shows a main door carcass 10 for a gaming machine. The door carcass 10 is shown before trim and other components are fitted. The door has an aperture 12 located below a shelf 14 on which control buttons are located on the finished door. The aperture is openable and closeable by a door known as a "belly door" (not shown in FIG. 1). The components of the belly door are shown in FIGS. 2 to 9. The belly door is mounted to the main door on two upstanding hinge pins 16, 18 disposed on one side of the aperture 12 of the door.

Figure 2:
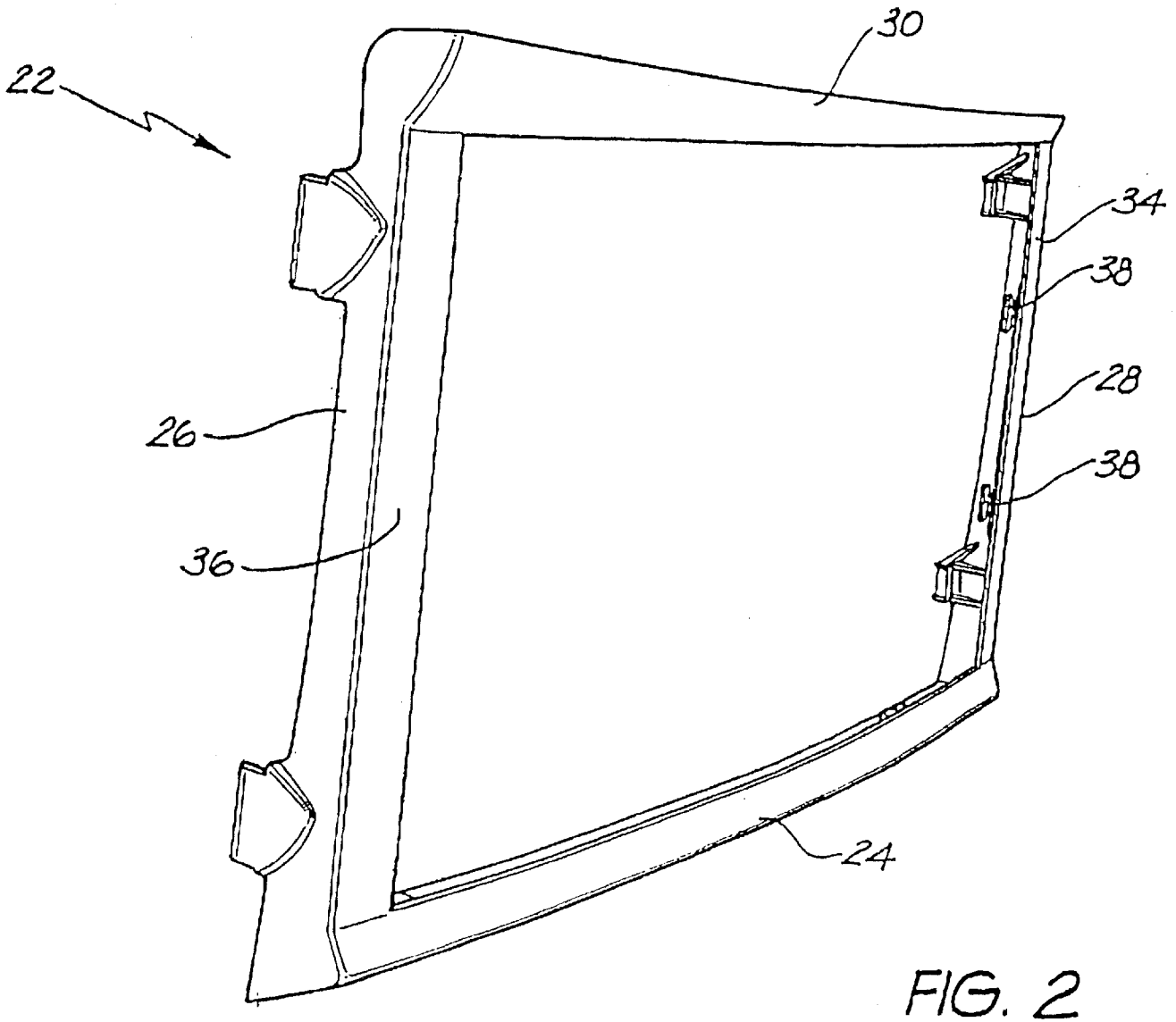
FIG. 2 shows a front view of a frame for a belly door for the main door shown in FIG. 1.
Figure 3:
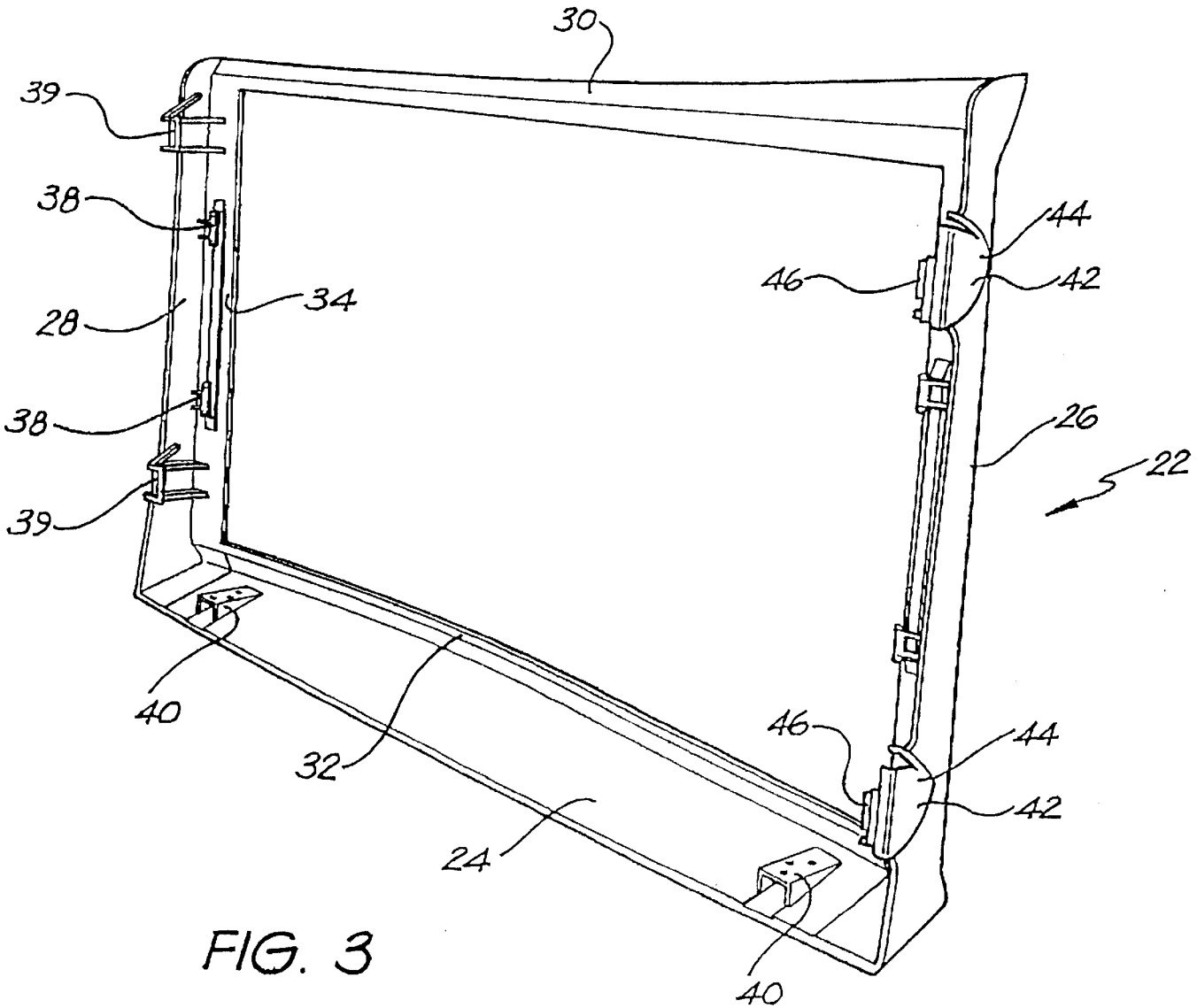
FIG. 3 shows a rear view of the frame for the belly door shown in FIG. 2.
Figure 4:
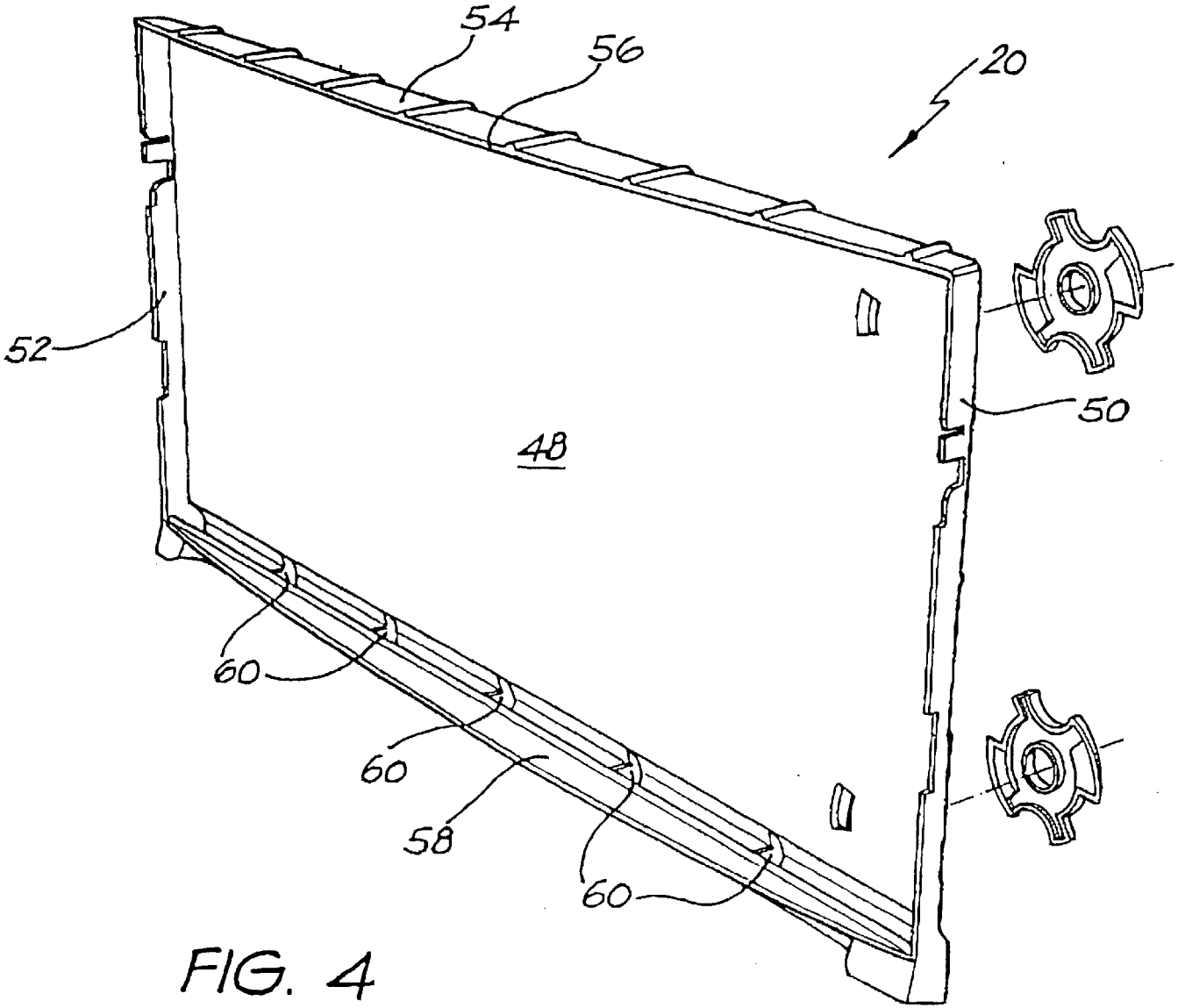
FIG. 4 shows a front view of a light chamber.
Figure 5:
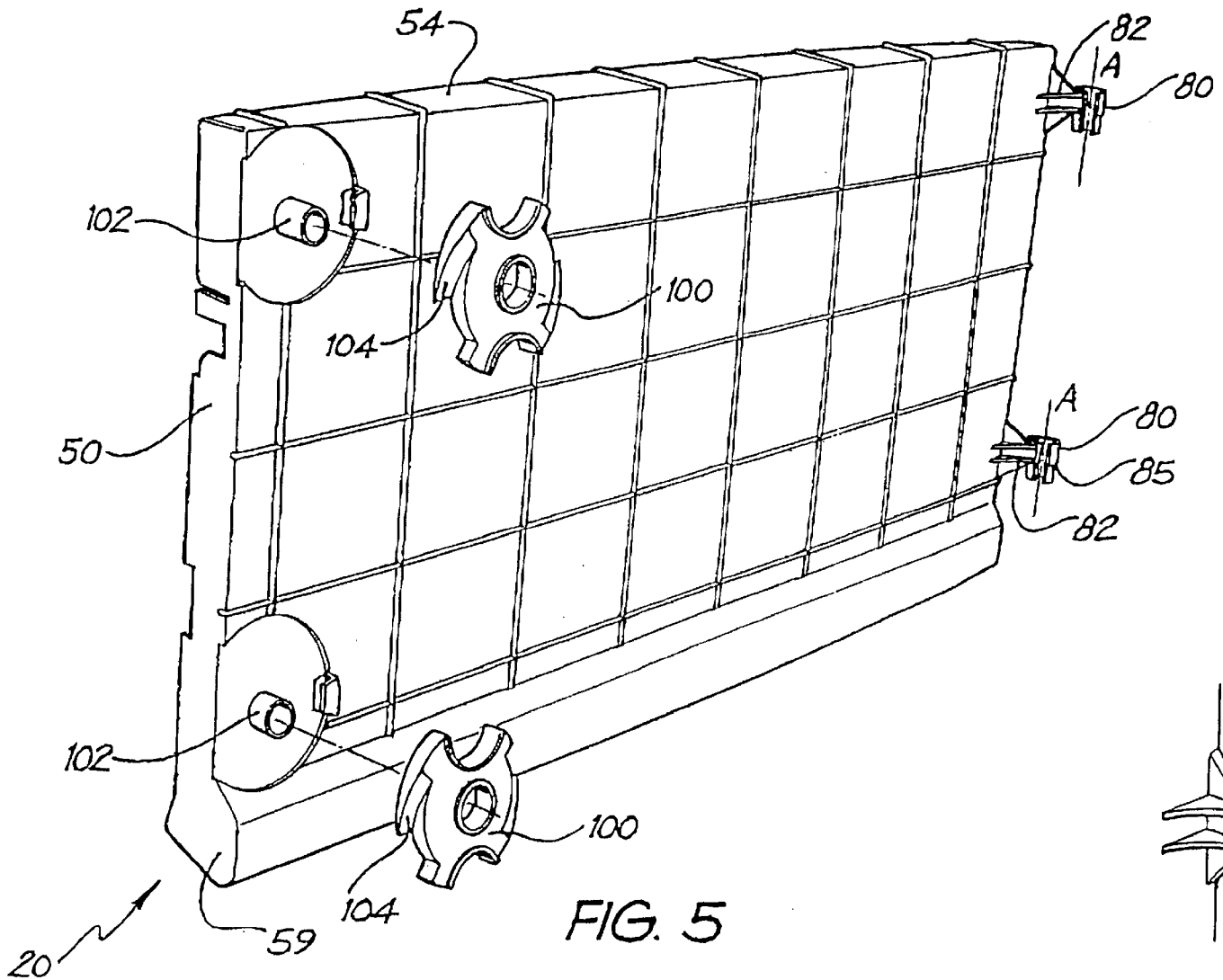
FIG. 5 is a rear view of the light chamber shown in FIG. 4.

The belly door includes two main components, a light chamber 20 shown in FIGS. 4 and 5 and an outer frame 22 which is shown in FIGS. 2 and 3. The door frame comprises a base member 24, two side members 26, 28 and a top member 30. As is best seen in FIG. 3, a curved wall 32 extends along the front of the base member 24. A similar curved wall (not shown) depends downwardly from the top member of the frame. When viewed from the front of the belly door, the walls are convex and they define the upper and lower edges of a frame for receiving artwork which locates behind the walls with its lower and upper side edges secured against the walls as is described in more detail below.

Each side member 26, 28 defines an edge wall 34, 36, behind which two spaced-apart projections 38 are provided which are oriented generally parallel to the edge side wall but are spaced apart from the edge wall by a gap of typically about 5 to 10 mm. The gap should be wider than the thickness of the sheet of artwork to be displayed in order to be able to receive the artwork in the frame between the walls and the projections.

In use, artwork, not shown, can be dropped into the door frame from above with the edges of the art work being loosely retained (until clamped, as is explained below) between the projections 38 and the edge walls.

Also shown in FIG. 3, are two mounts 40, onto which an elongate fluorescent light and socket assembly (not shown) is mounted using screws. The fluorescent light has a diameter of about 7 mm.

The belly door frame is hinged to the main door in conjunction with the light chamber on the hinge pins 16, 18 in a manner which will be described in more detail below.

FIGS. 3 and in particular 7, show two outer sleeves 42 which in use, are mounted on the hinge pins 16, 18. The outer sleeves 42 are generally part annular in shape. These, comprise an outer hinge sleeve element or arm 44 and an inner hinge sleeve element or arm 46 with a gap 47 therebetween for receiving the hinge pins as is described below. The outer sleeve element/arm 44 is taller than the inner sleeve element/arm 46. A support means in the form of a ledge 49 is defined in part by the top 46*a* of the inner sleeve element and in part by a shoulder 44*a* extending along an interior face outer sleeve element at the same height as the top 46*a*.

Also provided on one side member 28 of the frame is a pair of spaced lugs 39 whose function is described in more detail below.

The light chamber 20 is best seen in FIGS. 4 and 5. The light chamber is preferably made from a white coloured plastics material. The light chamber has a generally planar wall 48 with side walls 50, 52 and a top wall 54. The front edge 56 of the top wall is convex and curved to match the curved wall at the top of the frame 20. At the base of the chamber, an elongate channel or recess, best seen in FIG. 5, is defined. The channel extends the entire length of the base of the chamber and is sized and configured to receive the fluorescent light tube socket assembly which is mounted to the frame 20. A projecting clamp element 58 is disposed above the channel and, as best seen in FIG. 4, curves outwardly matching the curve of the wall 32 at the base of the frame 20. The protruding clamp element, does not extend back as far as the rear wall 48 of the chamber but rather is mounted on a series of five projecting ribs 60 which space the wall element from the rear wall 48.

Figure 9:
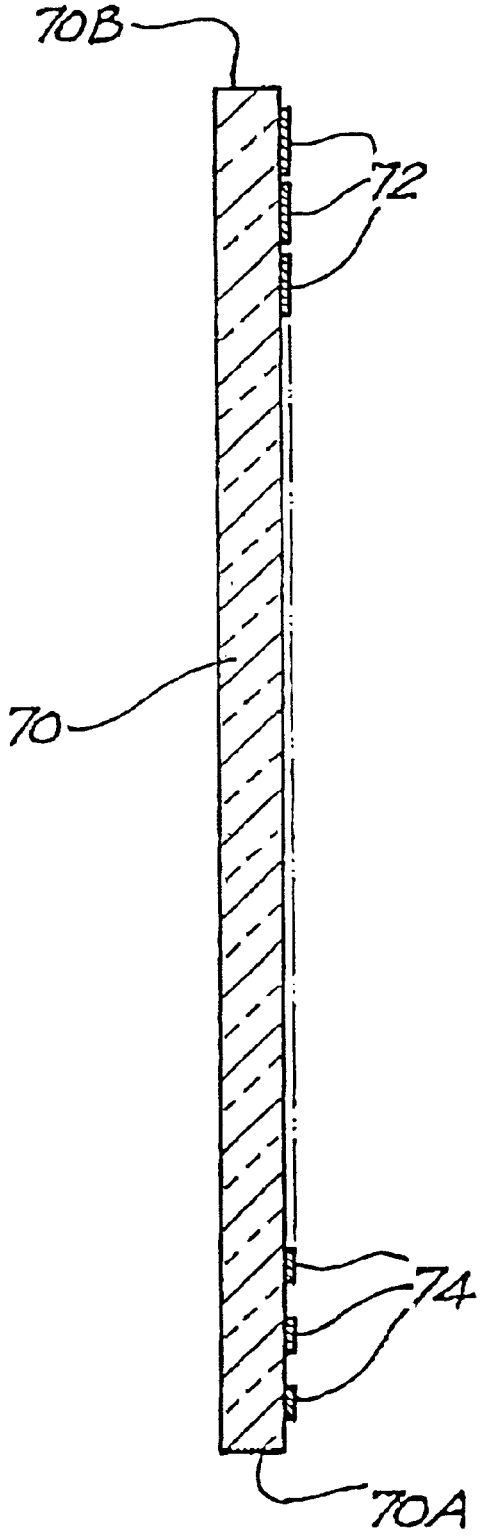
FIG. 9 shows a light diffuser panel.

A diffuser panel 70 illustrated in FIG. 9, locates in the chamber against the rear wall.

The diffuser panel is made of optical quality acrylic and has a series of opaque white dots screen printed onto the rear face of the panel. The dots 72 at the top 70B of the panel have a relatively greater diameter than smaller dots 74 at the bottom 70A of the panel. Typically, the smaller dots 74 have a diameter of about 0.3 mm, with the size gradually increasing up the panel to the relatively largest dots 72 having a diameter of about 0.5 mm. The panel is 8 mm thick. When the bottom edge 70A of the panel is lit by the fluorescent light, light travels up the panel and is diffused and reflected forwards by the series of white dots 72, 74 to provide a very even diffuse light source from the panel which takes account of the gradual reduction in the amount of light transmitted up the panel from the tube. Consequently, any art work held in the door frame in front of the panel is evenly lit.

Figure 6:
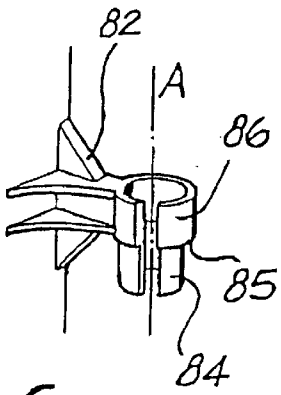
FIG. 6 is an enlarged view of a hinge component of the light chamber.
Figure 7:
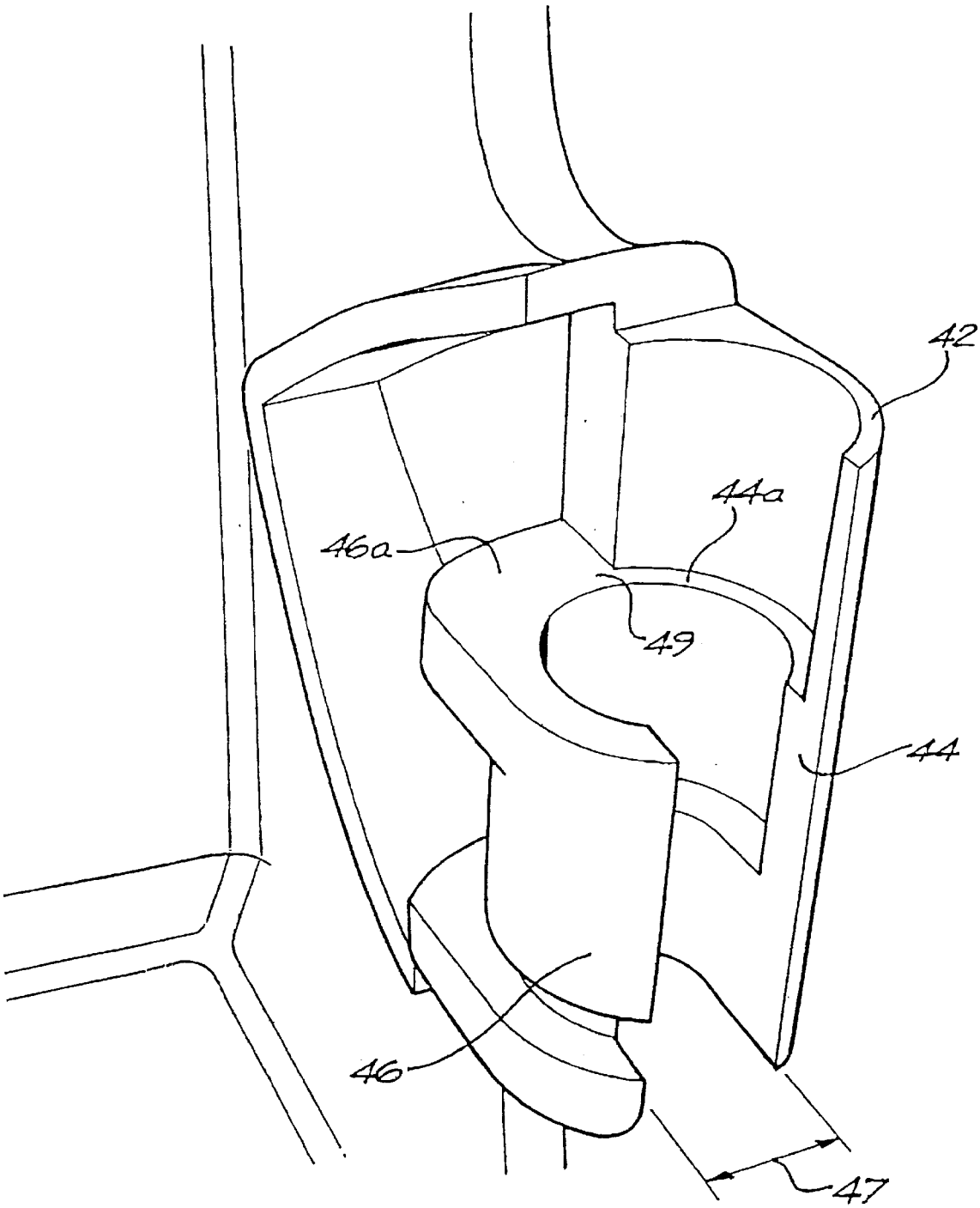
FIG. 7 is an enlarged view of a belly door hinge component.
Figure 8:
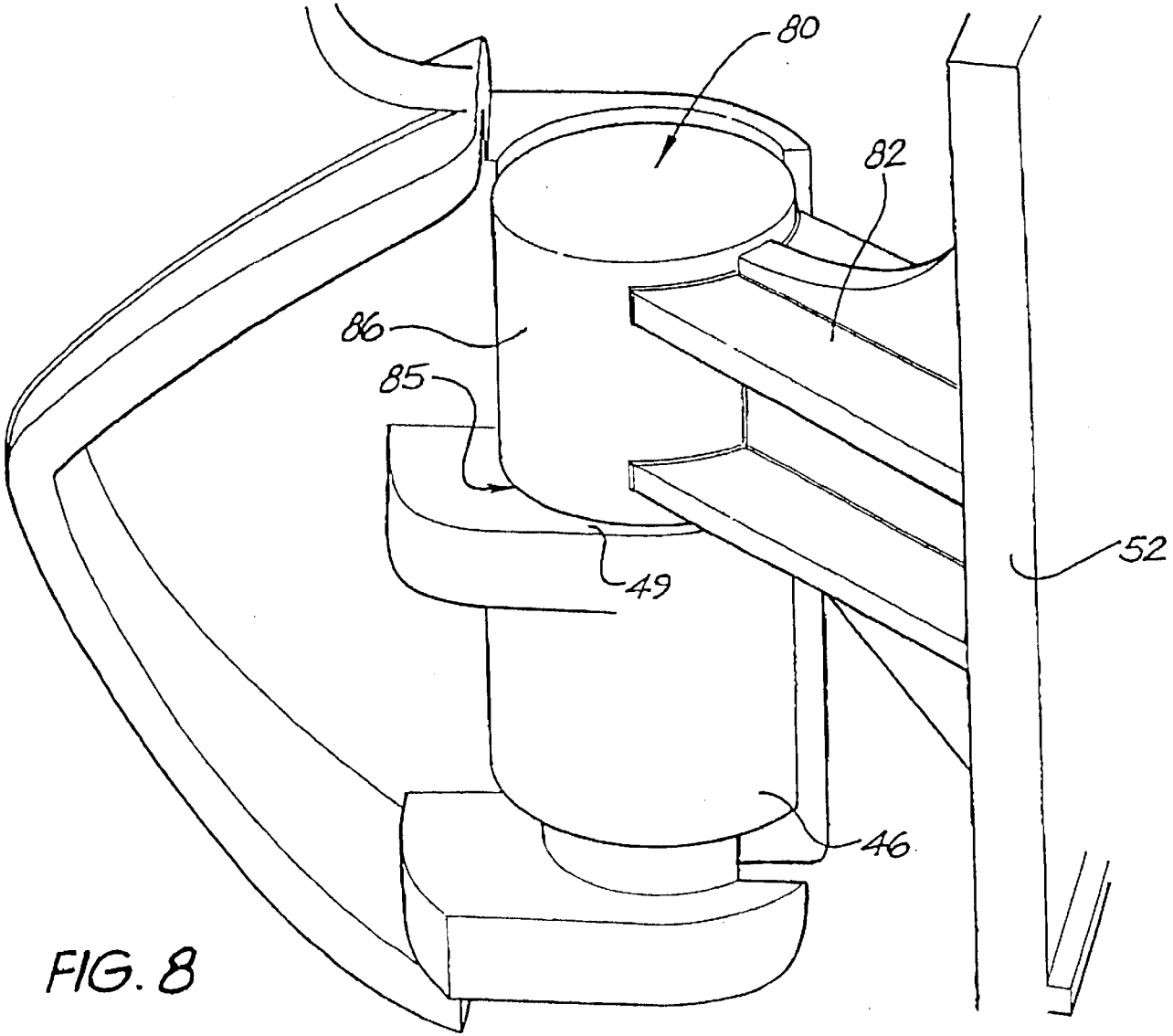
FIG. 8 is an enlarged view of a light chamber hinge component located in the belly door hinge component.

With reference to FIG. 5, two hinge pin elements 80 extend away from one side wall 52 of the chamber on arms 82. The hinge pin elements are shown enlarged in FIG. 6. Each element has a part annular cross section comprising a first upper portion 86 having a diameter which steps down at a shoulder 85 to a lower portion 84 having a slightly narrower diameter. The top of each hinge pin element may be closed as shown in FIG. 8 or open (FIG. 6). The walls of the hinge element are arcuate and extend around an angle of approximately 270° defining a gap of 90° between the free ends of the hinge element. The hinge element locates within the hinge sleeve elements provided on the frame, with the shoulder 85 resting on the ledge 49 defined at the top 46*a* of the inner sleeve element 46 as shown in FIG. 8. This allows the light chamber 22 to rotate about the hinge axis A relative to the frame 20. When the door frame and chamber are swung to a particular relative orientation, the gaps in the outer sleeves 42 and the hinge elements 80 align and in this orientation, the chamber and frame can be mounted onto the hinge pins 16, 18 defined on the main door. Once mounted thus, the main door, the frame and the chamber may all rotate relative to each other about the same hinge axis A. In relative orientations other than the particular orientation discussed above, the gaps are not aligned and the chamber and frame are not removable from the hinge pins. The orientation of the chamber and frame at which the gaps are aligned to allow removal of frame and chamber, is preferably one which would not occur during normal use of the belly door.

The chamber is locked in position to the reverse side of the belly door frame by means of a pair of rotatable locking cam/means 100 which are mounted on bosses 102 formed on the reverse side of the chamber. Each locking means defines a wedge or cam surface 104 which interacts with the lugs 39 defined on the side frame of the belly door. This has the effect of pushing the light chamber against the rear of the front face of the frame. The art work is held securely between the chamber and the door frame and is gripped and curved between the walls of the frame and the projections of the chambers.

The design of the door frame has a number of significant advantages. The principal advantage is that it is much easier to access the components of the belly door which need changing, in particular, the art work, which is changed when the game played on the gaming machine is changed. It is also a relatively simple matter to access and change the fluorescent light as only one light is required and it conveniently located at the base of the frame of the belly door frame. The belly door assembly can be easily assembled and if necessary disassembled due to the novel hinging arrangement. The hinging means is also compact. The hinge assembly of the present invention may be utilised outside the field of gaming machines.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A hinge assembly comprising:

a hinge pin, fixed to a first member;

an outer sleeve fixed to a second member, the outer sleeve comprising first and second arcuate arms defining opposed ends such that the sleeve is part-annular in cross-section defining a first arcuate gap between the opposing ends of the arms and wherein the sleeve defines an interior surface on which a support member is defined; and a part-annular pin element fixed to a third member, the part-annular pin element defining opposed free ends and a second gap therebetween and the pin element being rotatably mounted inside the outer sleeve, and wherein the pin element defines a shoulder which rests on the support member defined by the outer sleeve and wherein when the pin element is rotated to a particular orientation with respect to the outer sleeve, the first and second gaps align to allow the pin element and outer sleeve to be simultaneously mounted around the hinge pin, with subsequent relative rotation of the pin element and outer sleeve inhibiting the pin element and outer sleeve from becoming disengaged from the hinge pin.

2. A hinge assembly as claimed in claim 1, wherein the first and second gaps are from 65 degrees to 125 degrees wide.

3. A hinge assembly as claimed in claim 2, wherein the first and second gaps are from 80 to 105 degrees wide.

4. The hinge assembly of claim 3, wherein the first and second gaps are about 90 degrees wide.

5. A hinge assembly as claimed in claim 1, wherein, when the sleeve is vertically oriented in an upright position, the height of the top of the first arm is lower than the height of the second arm, with the upper face of the first arm defining part of the support member.

6. A gaming machine incorporating a hinge assembly, the hinge assembly comprising:

a hinge pin, fixed to a first member;

an outer sleeve fixed to a second member, the outer sleeve comprising first and second arcuate arms defining opposed ends such that the sleeve is part-annular in cross-section defining an arcuate gap between the opposing ends of the arms and wherein the sleeve defines an interior surface on which a support member is defined; and a part-annular pin element fixed to a third member, the part-annular pin element defining opposed free ends and a second gap therebetween and the pin element being rotatably mounted inside the outer sleeve, wherein the pin element defines a shoulder which rests on the support member, wherein, when the pin element is rotated to a particular orientation with respect to the outer sleeve, the first and second gaps align to allow the pin element and outer sleeve to be simultaneously mounted around the hinge pin, with subsequent relative rotation of the pin element and outer sleeve inhibiting the pin element and outer sleeve from becoming disengaged from the hinge pin, wherein the first member is a main door for a gaming machine, the second member is a frame for a belly door of a gaming machine, and the third member is a chamber adapted to seal against the frame of the belly door.

7. A gaming machine as claimed in claim 6, wherein the second and third members are not generally parallel, when the first and second gaps are aligned.

8. A gaming machine including:

a main door;

a frame of a belly door;

a chamber adapted to seal against the frame of the belly door; a hinge pin defined on the first door;

an outer sleeve fixed to the frame, the outer sleeve comprising first and second arcuate arms defining opposing ends such that the sleeve is part-annular in cross-section defining a gap between the opposing ends of the arms and wherein the sleeve defines an interior surface on which a support member is defined below the top of the sleeve; and a part-annular pin element fixed to the chamber, the part-annular pin element defining opposed free ends and a second gap therebetween and the pin element being rotatably mounted inside the outer sleeve and wherein the pin element defines a shoulder which rests on the support member, and wherein, when the pin element is rotated to a particular orientation with respect to the outer sleeve, the first and second gaps align to allow the pin element and outer sleeve to be simultaneously mounted around the hinge pin, with subsequent relative rotation of the pin element and outer sleeve inhibiting the pin element and outer sleeve from becoming disengaged from the hinge pin.

9. The gaming machine of claim 8, wherein the first and second gaps are from 80 to 105 degrees wide.

10. The gaming machine of claim 9, wherein when the sleeve is vertically oriented in an upright position, the height of the top of the first arm is lower than the height of the second arm, with the upper face of the first arm defining part of the support member.

11. The gaming machine of claim 9, wherein the first and second gaps are about 90 degrees wide.

12. The gaming machine of claim 8, wherein, when the second and third members are generally parallel, the first and second gaps are not aligned.

* * * * *